US010810922B2

(12) United States Patent
Saeki

(10) Patent No.: US 10,810,922 B2
(45) Date of Patent: Oct. 20, 2020

(54) DEVICE AND METHOD FOR DRIVING DISPLAY PANEL

(71) Applicant: Synaptics Incorporated, San Jose, CA (US)

(72) Inventor: Yutaka Saeki, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/280,159

(22) Filed: Feb. 20, 2019

(65) Prior Publication Data

US 2019/0259322 A1 Aug. 22, 2019

(30) Foreign Application Priority Data

Feb. 22, 2018 (JP) ..... 2018-029464
Feb. 18, 2019 (JP) ..... 2019-026400

(51) Int. Cl.
*G09G 3/20* (2006.01)

(52) U.S. Cl.
CPC ..... *G09G 3/20* (2013.01); *G09G 2300/0426* (2013.01); *G09G 2300/0828* (2013.01); *G09G 2310/027* (2013.01); *G09G 2310/0291* (2013.01)

(58) Field of Classification Search
CPC ..... G09G 3/20; G09G 2300/0426; G09G 2300/0828; G09G 2310/0291; G09G 2310/027
See application file for complete search history.

(56) References Cited

U.S. PATENT DOCUMENTS

2009/0167747 A1* 7/2009 Gong ..... G09G 3/3688 345/212
2019/0206326 A1* 7/2019 Wang ..... G09G 3/2003

* cited by examiner

*Primary Examiner* — Towfiq Elahi
(74) *Attorney, Agent, or Firm* — Patterson + Sheridan, LLP

(57) ABSTRACT

A display driver comprises a digital-to-analog converter (DAC) configured to output a grayscale voltage corresponding to an image data. The display driver further comprises a source amplifier configured to drive a source line of a display panel, and a buffer connected between the DAC and the source amplifier. The buffer comprises a first NMOS transistor having a gate supplied with the grayscale voltage and a drain connected to a power supply. The buffer is configured to supply a current depending on a first current flowing through the first NMOS transistor to an input terminal of the source amplifier.

19 Claims, 8 Drawing Sheets

DEVICE AND METHOD FOR DRIVING DISPLAY PANEL

CROSS REFERENCE

This application claims priority to Japanese Patent Application No. 2018-029464, filed on Feb. 22, 2018, and Japanese Patent Application No. 2019-026400, filed on Feb. 18, 2019, the disclosures of which are incorporated herein by reference in their entirety.

BACKGROUND

Field

The present disclosure relates to a display driver and a display device.

Description of the Related Art

A display driver configured to drive a display panel such as a liquid crystal display (LCD) panel or an organic light emitting diode (OLED) display panel may be configured to drive source lines, which may be also referred to as signal lines or data lines. A display driver is often designed to display images at a high refresh rate.

SUMMARY

In one or more embodiments, a display driver comprises a digital-to-analog converter (DAC) configured to output a grayscale voltage corresponding to an image data; a source amplifier configured to drive a source line of a display panel, and a buffer connected between the DAC and the source amplifier. The buffer comprises an NMOS transistor having a gate supplied with the grayscale voltage and a drain connected to a power supply. The buffer is configured to supply to an input terminal of the source amplifier a current that depends on a current flowing through the NMOS transistor.

In one or more embodiments, a display device comprises a display panel comprising a source line and a display driver configured to drive the display panel. The display driver comprises a digital-to-analog converter (DAC) configured to output a grayscale voltage corresponding to an image data, a source amplifier configured to drive the source line of the display panel, and a buffer connected between the DAC and the source amplifier. The buffer comprises an NMOS transistor having a gate supplied with the grayscale voltage and a drain connected to a power supply. The buffer is configured to supply to an input terminal of the source amplifier a current that depends on a current flowing through the NMOS transistor.

In one or more embodiments, a method of driving a display panel comprises: outputting a grayscale voltage corresponding to an image data, supplying to an input terminal of a source amplifier a current that depends on a current flowing through an NMOS transistor having a gate supplied with the grayscale voltage and a drain connected to a power supply, and driving a source line of a display panel with the source amplifier.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
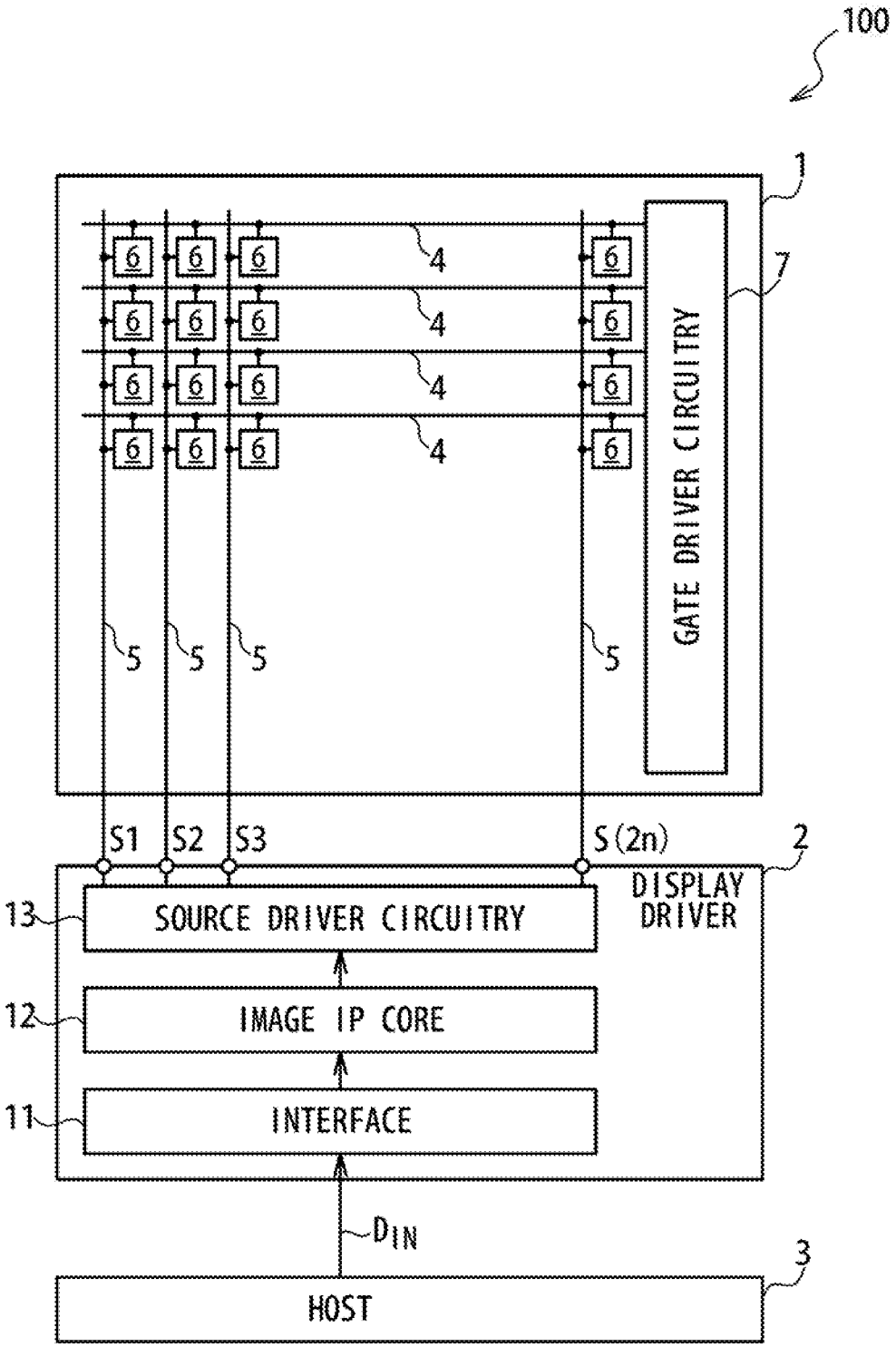
FIG. 1 is a block diagram illustrating an example configuration of a display device, according to one or more embodiments.

In the following, a description is given of embodiments of the present disclosure with reference to the attached drawings. In the attached drawings, same or similar components may be denoted by same or corresponding reference numerals. Suffixes may be attached to reference numerals to distinguish the same components from each other.

In one or more embodiments, as illustrated in FIG. 1, a display device 100 comprises a display panel 1 and a display driver 2. In one or more embodiments, the display device 100 is configured to display an image on the display panel 1 based on an image data $D_{IN}$ received from a host 3.

In one or more embodiments, the display panel 1 comprises gate lines 4, source lines 5, pixel circuits 6, and gate driver circuitry 7. In one or more embodiments, each pixel circuit 6 is disposed at an intersection of a corresponding gate line 4 and source line 5, and used as a subpixel of a pixel of the display panel 1. When a liquid crystal display (LCD) panel is used as the display panel 1, each pixel circuit 6 may comprise a pixel electrode, a select transistor, and a storage capacitor. When an organic light emitting diode (OLED) display panel is used as the display panel 1, each pixel circuit 6 may comprise a light emitting element, a select transistor, and a storage capacitor. The display panel 1 may additionally comprise various lines other than the gate lines 4 and the source lines 5, depending on the configuration of the pixel circuits 6.

In one or more embodiments, the display driver 2 comprises source outputs S1 to S(2*n*) respectively connected to the source lines 5 of the display panel 1. In one or more embodiments, the display driver 2 is configured to drive the source lines 5 based on the image data $D_{IN}$ received from the host 3. The display driver 2 may comprise an interface 11, an image IP core 12, and source driver circuitry 13. In one or more embodiments, the interface 11 is configured to transfer to the image IP core 12 the image data $D_{IN}$ received from the host 3. In one or more embodiments, the image IP core 12 performs desired image processing on the image data $D_{IN}$. In one or more embodiments, the source driver circuitry 13 is configured to drive the source lines 5 of the display panel 1 based on an image data output from the image IP core 12.

Figure 2:
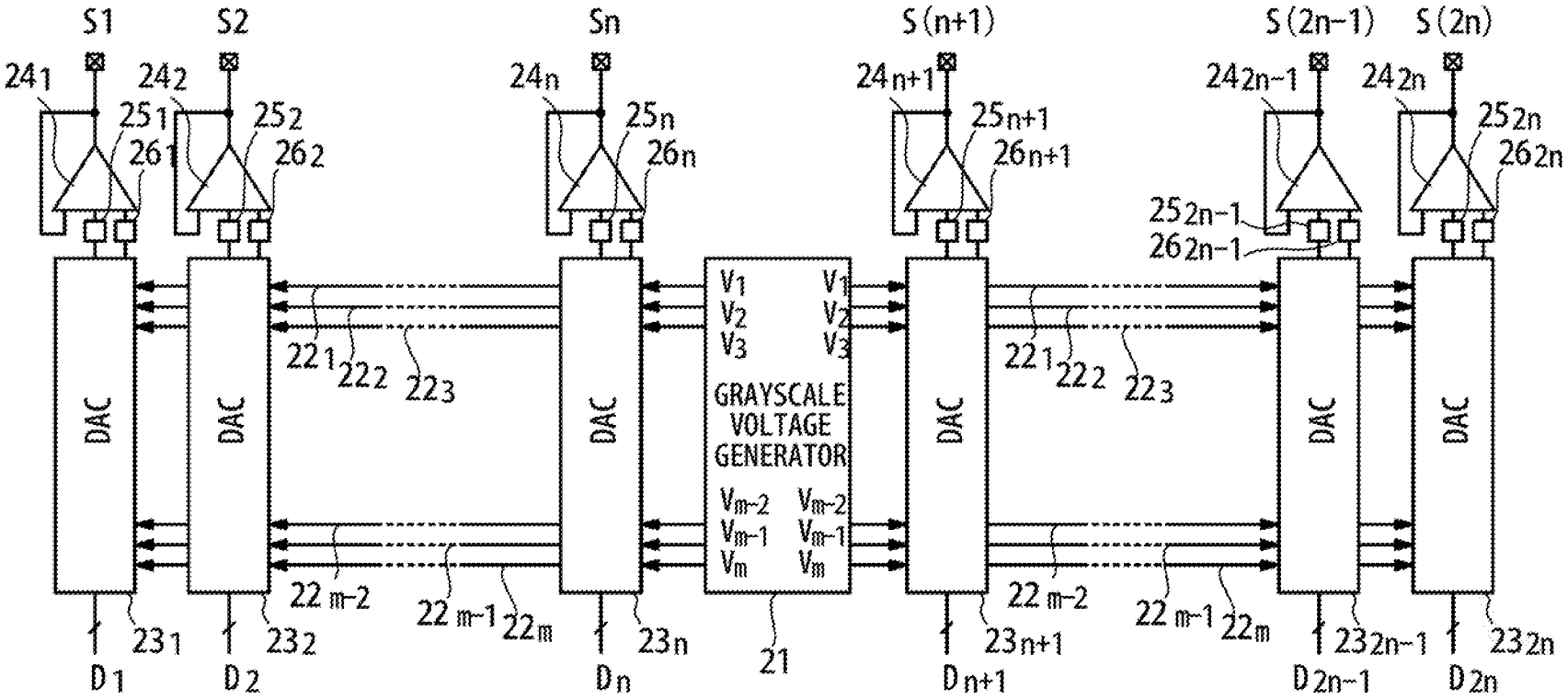
FIG. 2 is a circuit diagram illustrating an example configuration of a source driver circuitry, according to one or more embodiments.

In one or more embodiments, as illustrated in FIG. 2, the source driver circuitry 13 comprises grayscale voltage generator circuitry 21, grayscale voltage lines $\mathbf{22}_1$ to $\mathbf{22}_m$, digital-to-analog converters (DACs) $\mathbf{23}_1$ to $\mathbf{23}_{2n}$, and source amplifiers $\mathbf{24}_1$ to $\mathbf{24}_{2m}$. In FIG. 2, the legends "$D_1$" to "$D_{2n}$" denote image data associated with the source outputs S1 to S(2*n*), respectively.

In one or more embodiments, the grayscale voltage generator circuitry 21 is configured to generate grayscale voltages $V_1$ to $V_m$ respectively associated with allowed grayscale values of the image data $D_1$ to $D_{2n}$ and supply the grayscale voltages $V_1$ to $V_m$ to the DACs $\mathbf{23}_1$ to $\mathbf{23}_{2n}$, via the grayscale voltage lines $\mathbf{22}_1$ to $\mathbf{22}_m$. In one or more embodiments, the grayscale voltages $V_1$ to $V_m$ have different voltage levels from one another.

In one or more embodiments, the DACs $\mathbf{23}_1$ to $\mathbf{23}_{2n}$ are configured to select the grayscale voltages $V_1$ to $V_m$ received via the grayscale voltage lines $\mathbf{22}_1$ to $\mathbf{22}_m$, based on the grayscale values described in the image data $D_1$ to $D_{2n}$ and output the selected grayscale voltages. In one or more embodiments, each DAC $\mathbf{23}_i$ is configured to operate as a selector that selects two of the grayscale voltage lines $\mathbf{22}_1$ to $\mathbf{22}_m$ based on a grayscale value described in the image data $D_i$ and connects the selected two grayscale voltage lines 22 to an output terminal thereof. In one or more embodiments, each DAC $\mathbf{23}_i$ itself fails to have a driving ability.

The source amplifiers $\mathbf{24}_1$ to $\mathbf{24}_{2n}$ are configured to drive the source outputs S1 to S(2*n*) based on the grayscale voltages selected by the DACs $\mathbf{23}_1$ to $\mathbf{23}_{2n}$. In one or more embodiments, each source amplifier $\mathbf{24}_i$ has two inputs and is configured to drive the source output Si based on the voltages supplied to the two inputs.

Figure 3:
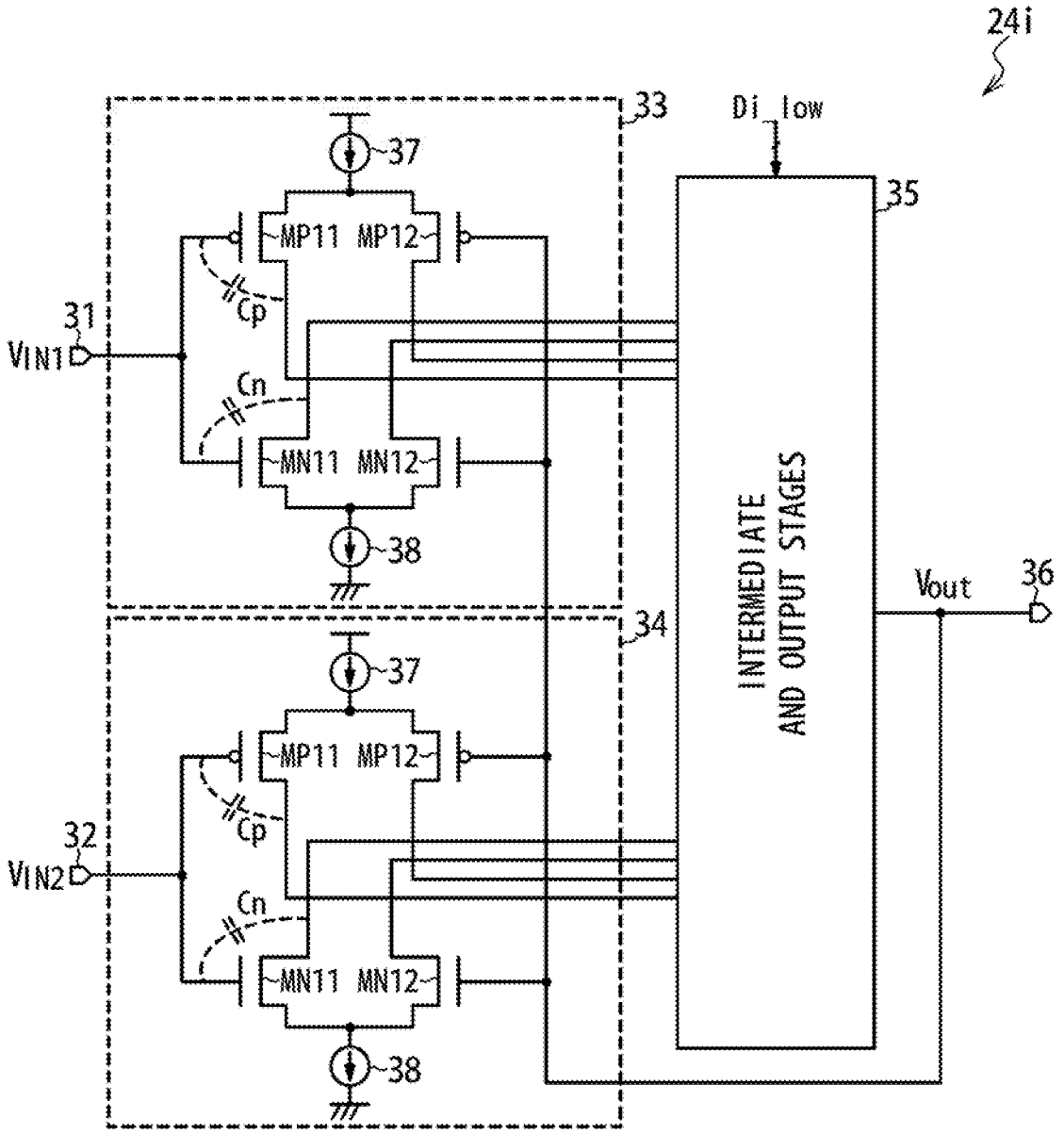
FIG. 3 is a circuit diagram illustrating an example configuration of a source amplifier, according to one or more embodiments.

As illustrated in FIG. 3, in one or more embodiments, each source amplifier $\mathbf{24}_i$ may comprise two input terminals 31, 32, two input stages 33, 34, intermediate and output stages, and an output terminal 36. In FIG. 3, the intermediate and output stages are collectively denoted by the numeral 35.

In one or more embodiments, the input stage 33 comprises PMOS transistors MP11, MP12, NMOS transistors MN11, MN12, and constant current sources 37 and 38. In one or more embodiments, sources of the PMOS transistors MP11 and MP12 are commonly connected to the constant current source 37 and drains of the same are commonly connected to the intermediate stage. In one or more embodiments, the PMOS transistor MP11 has a gate connected to the input terminal 31, and the PMOS transistor MP12 has a gate connected to the output terminal 36. In one or more embodiments, the input stage 34 is configured similarly to the input stage 33 except for that the PMOS transistor MP11 and the NMOS transistor MN11 are connected to the input terminal 32.

In one or more embodiments, the intermediate and output stages 35 are configured to output an output voltage $V_{OUT}$ based on lower bits $D_{i_low}$ of the image data $D_i$ and input voltages $V_{IN1}$ and $V_{IN2}$ supplied to the input terminals 31 and 32, respectively. In one or more embodiments, the input voltage $V_{IN2}$ supplied to the input terminal 32 may be higher than the input voltage $V_{IN1}$ supplied to the input terminal 31, and the intermediate and output stages 35 may be configured to output the output voltage $V_{OUT}$ based on the lower bits $D_{i_low}$ of the image data $D_i$ so that the output voltage $V_{OUT}$ ranges from the input voltage $V_{IN1}$ to the input voltage $V_{IN2}$.

In one or more embodiments, the capacitance of the input terminal 31 of each source amplifier $\mathbf{24}_i$ is approximately the sum of the gate capacitances Cp and Cn of the PMOS transistor MP11 and NMOS transistors MN11 of the input stage 33, and the capacitance of the input terminal 32 is approximately the sum of the gate capacitances Cp and Cn of the PMOS transistor MP11 and NMOS transistor MN11 of the input stage 34. In one or more embodiments, as the gate capacitances Cp and Cn of the PMOS transistors MP11 and NMOS transistors MN11 are minimal, the capacitances of the input terminals 31 and 32 of each source amplifier $\mathbf{24}_i$ are considerably smaller than the capacitances of the grayscale voltage lines $\mathbf{22}_1$ to $\mathbf{22}_m$.

In one or more embodiments, the refresh rate of the display device 100 may be increased by reducing delays in the rising and falling input voltages of the source amplifiers $\mathbf{24}_1$ to $\mathbf{24}_{2n}$. For example, in one or more embodiments, reducing the effective input capacitances of the source amplifiers $\mathbf{24}_1$ to $\mathbf{24}_{2n}$ reduces the delays in the rising and falling input voltages of the source amplifiers $\mathbf{24}_1$ to $\mathbf{24}_{2n}$, which increases the refresh rate of the display device 100.

In one embodiment, the effective input capacitances of the source amplifiers $\mathbf{24}_1$ to $\mathbf{24}_{2n}$ are reduced by reducing influences of a Miller effect on the source amplifiers $\mathbf{24}_1$ to $\mathbf{24}_{2n}$. The Miller effect may increase the effective input capacitance of each source amplifier $\mathbf{24}_1$ to $\mathbf{24}_{2n}$ to 1+A times the capacitance of a respective input terminal of each source amplifier $\mathbf{24}_1$ to $\mathbf{24}_{2n}$, where A is the gain of each respective source amplifier $\mathbf{24}_1$ to $\mathbf{24}_{2n}$.

In one or more embodiments, the source driver circuitry 13 is configured to achieve rapid rising and falling of the input voltages of the source amplifiers $\mathbf{24}_1$ to $\mathbf{24}_{2n}$, increasing the refresh rate of the display device 100, by at least minimizing the Miller effect of each source amplifier $\mathbf{24}_1$ to $\mathbf{24}_{2n}$. For example, minimizing the Miller effect of each source amplifier may reduce the effective input capacitance of the source amplifiers $\mathbf{24}_1$ to $\mathbf{24}_{2n}$, and reduce delays in the rising and falling input voltages of the source amplifiers $\mathbf{24}_1$ to $\mathbf{24}_{2n}$.

In one or more embodiments, to reduce the effective input capacitances of the source amplifiers $\mathbf{24}_1$ to $\mathbf{24}_{2n}$ viewed from the grayscale voltage lines $\mathbf{22}_1$ to $\mathbf{22}_m$, buffers $\mathbf{25}_1$ to $\mathbf{25}_{2n}$ and $\mathbf{26}_1$ to $\mathbf{26}_{2n}$ are inserted between the DACs $\mathbf{23}_1$ to $\mathbf{23}_{2n}$ and the source amplifiers $\mathbf{24}_1$ to $\mathbf{24}_{2n}$.

Figure 4:
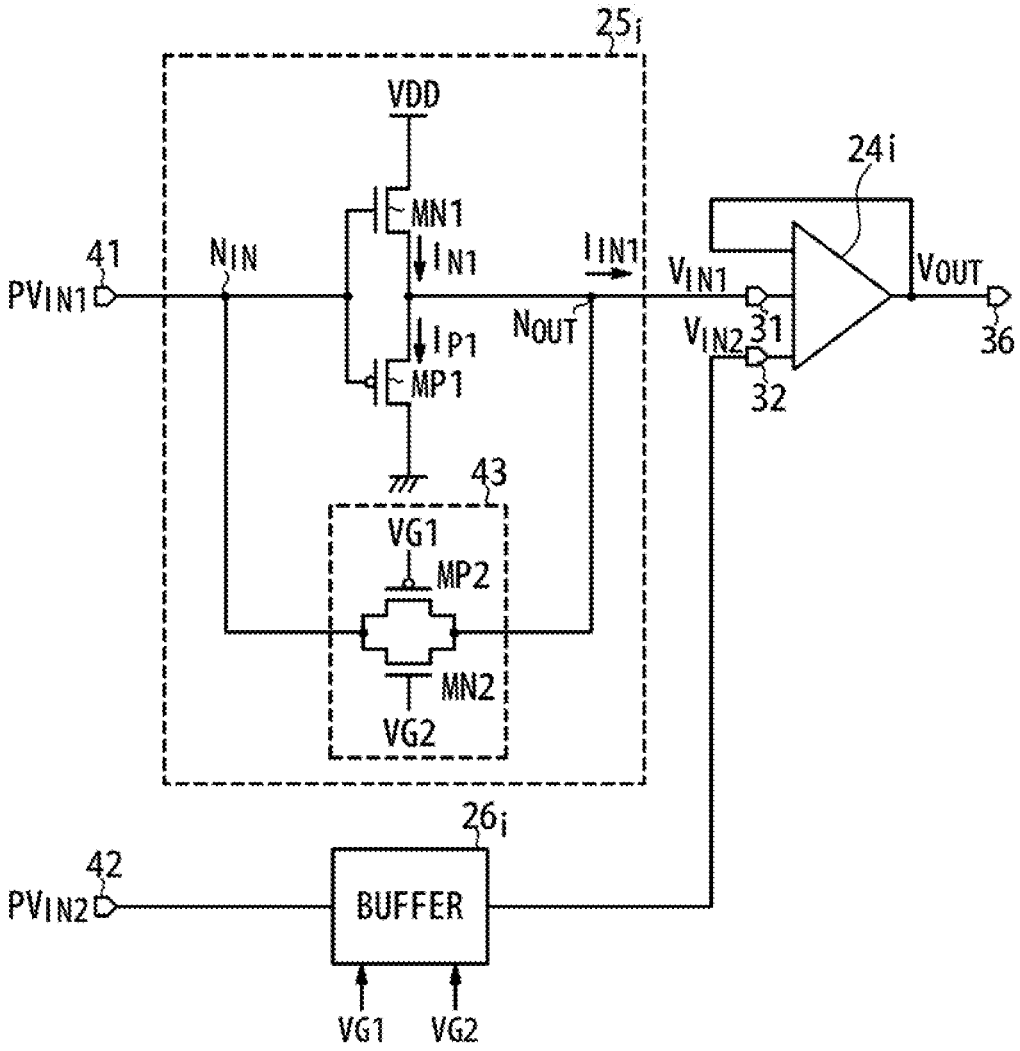
FIG. 4 is a circuitry diagram illustrating an example configuration of a buffer, according to one or more embodiments.

FIG. 4 is a circuit diagram illustrating one example configuration of the buffer $\mathbf{25}_i$ connected to the input terminal 31 of the source amplifier $\mathbf{24}_i$, according to one or more embodiments. In FIG. 4, the numerals 41 and 42 denote two output terminals of the DAC $\mathbf{23}_i$. In one or more embodiments, the DAC $\mathbf{23}_i$ is configured to connect two of the grayscale voltage lines $\mathbf{22}_1$ to $\mathbf{22}_m$ to the output terminals 41 and 42, based on the grayscale value described in the image data $D_i$. The buffer $\mathbf{25}_i$ has an input node $N_{IN}$ connected to the output terminal 41 of the DAC $\mathbf{23}_i$ and an output node $N_{OUT}$ connected to the input terminal 31 of the source amplifier $\mathbf{24}_i$. The configuration and operation of the buffer $\mathbf{26}_i$, which is connected to the input terminal 32 of the source amplifier $\mathbf{24}_i$, are similar to those of the buffer $\mathbf{25}_i$. The circuit configuration of the buffer $\mathbf{26}_i$ is not illustrated in FIG. 4.

In one or more embodiments, the buffer $\mathbf{25}_i$ comprises an NMOS transistor MN1, a PMOS transistor MP1, and a switch 43.

In one or more embodiments, the NMOS transistor MN1 and the PMOS transistor MP1 are each configured to drive the input terminal 31 of the source amplifier $\mathbf{24}_i$ through a source follower operation. In one or more embodiments, gates of the NMOS transistor MN1 and the PMOS transistor MP1 are commonly connected to the input node $N_{IN}$ to receive a grayscale voltage $PV_{IN1}$ from the output terminal 41 of the DAC $\mathbf{23}_i$. In one or more embodiments, the NMOS transistor MN1 has a drain connected to a power supply configured to supply a power supply voltage VDD and a source connected to the output node $N_{OUT}$. In one or more embodiments, the PMOS transistor MP1 has a drain connected to a circuit ground and a source connected to the output node $N_{OUT}$. In one or more embodiments, the NMOS transistor MN1 operates as a pull-up transistor configured to pull up the input terminal 31 of the source amplifier $\mathbf{24}_i$, and the PMOS transistor MP1 operates as a pull-down transistor configured to pull down the input terminal 31.

In one or more embodiments, a current $I_{N1}$ is generated through the NMOS transistor MN1, based on the grayscale voltage $PV_{IN1}$ supplied to the gate of the NMOS transistor MN1, and the NMOS transistor MN1 is configured to supply the current $I_{N1}$ to the input terminal 31 of the source amplifier $\mathbf{24}_i$. Similarly, in one or more embodiments, a current $I_{P1}$ is generated through the PMOS transistor MP1, based on the grayscale voltage $PV_{IN1}$ supplied to the gate of the PMOS transistor MP1, and the PMOS transistor MP1 is configured to draw the current $I_{P1}$ from the input terminal 31 of the source amplifier $\mathbf{24}_i$.

In one or more embodiments, the switch 43 comprises an NMOS transistor MN2 and a PMOS transistor MP2. In one or more embodiments, the NMOS transistor MN2 and the PMOS transistor MP2 form a transmission gate connected between the input node $N_{IN}$ and the output node $N_{OUT}$. In one or more embodiments, the NMOS transistor MN2 has a drain connected to the input node $N_{IN}$ and a source connected to the output node $N_{OUT}$. In one or more embodiments, the PMOS transistor MP2 has a source connected to the input node $N_{IN}$ and a drain connected to the output node $N_{OUT}$. In one or more embodiments, a gate of the NMOS transistor MN2 is supplied with a control signal VG1 and a gate of the PMOS transistor MP2 is supplied with a control signal VG2. In one or more embodiments, the switch 43 is configured to electrically connect or disconnect the input node $N_{IN}$ to or from the output node $N_{OUT}$ under control of the control signals VG1 and VG2.

Figure 5:
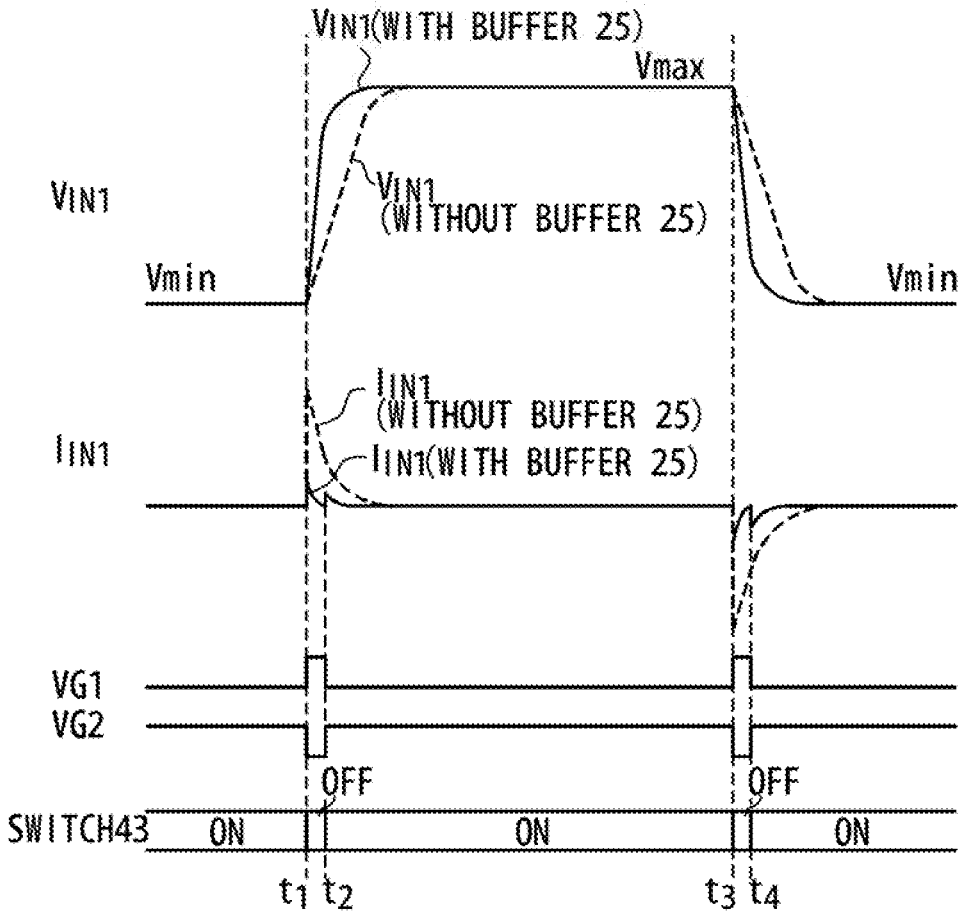
FIG. 5 is a timing chart illustrating an example operation of the buffer, according to one or more embodiments.

FIG. 5 illustrates one example operation of the buffer $\mathbf{25}_i$, according to one or more embodiments. In one or more embodiments, at time $t_0$, the grayscale voltage $PV_{IN1}$ is Vmin and the switch 43 is set to the ON state, where Vmin is the allowed lowest grayscale voltage. In the operation illustrated in FIG. 5, the input voltage $V_{IN1}$ supplied to the input terminal 31 of the source amplifier $\mathbf{24}_i$ is Vmin at time $t_0$.

In one or more embodiments, the image data $D_i$ supplied to the DAC $\mathbf{23}_i$ changes at time $t_1$, and the grayscale voltage $PV_{IN1}$ supplied from the DAC $\mathbf{23}_i$ to the buffer $\mathbf{25}_i$ also changes accordingly. FIG. 5 illustrates an example operation in which the grayscale voltage $PV_{IN1}$ changes from Vmin to Vmax at time $t_1$, where Vmax is the allowed highest grayscale voltage, according to one or more embodiments.

In one or more embodiments, the switch 43 is set to the OFF state by the control signals VG1 and VG2 at time $t_1$ in synchronization with the change in the image data $D_i$. In one or more embodiments, when the switch 43 is turned OFF, the NMOS transistor MN1 operates as a source follower to supply the current $I_{N1}$ to the input terminal 31 of the source amplifier $\mathbf{24}_i$. In one or more embodiments, this increases the voltage level on the input terminal 31. In one or more embodiments, when the threshold voltage of the NMOS transistor MN1 is $V_{TH_N}$, the NMOS transistor MN1 pulls up the input terminal 31 of the source amplifier $\mathbf{24}_i$ to $Vmax-V_{TH_N}$.

In one or more embodiments, this is followed by setting the switch 43 to the ON state by the control signals VG1 and VG2 at time $t_2$. When the switch 43 is turned ON, in one or more embodiments, the output terminal 41 of the DAC $\mathbf{23}_i$ is electrically connected to the input terminal 31 of the source amplifier $\mathbf{24}_i$, and thereby the input terminal 31 of the source amplifier $\mathbf{24}_i$ is pulled up to Vmax.

In one or more embodiments, when the image data $D_i$ supplied to the DAC $\mathbf{23}_i$ then changes at time $t_3$, the grayscale voltage $PV_{IN1}$ supplied from the DAC $\mathbf{23}_i$ to the buffer $\mathbf{25}_i$ also changes. FIG. 5 illustrates an operation in which the grayscale voltage $PV_{IN1}$ changes from Vmax to Vmin at time $t_3$, according to one or more embodiments.

In one or more embodiments, the switch 43 is set to the OFF state by the control signals VG1 and VG2 at time $t_3$ in synchronization with the change in the image data $D_i$. In one or more embodiments, when the switch 43 is turned OFF, the PMOS transistor MP1 operates as a source follower to draw the current $I_{P1}$ from the input terminal 31 of the source amplifier $\mathbf{24}_i$. In one or more embodiments, this decreases the voltage level on the input terminal 31. In one or more embodiments, when the threshold voltage of the PMOS transistor MP1 is $-V_{TH_P}$, the PMOS transistor MP1 pulls down the input terminal 31 of the source amplifier $\mathbf{24}_i$ to $Vmin+V_{TH_P}$.

In one or more embodiments, this is followed by setting the switch 43 to the ON state by the control signals VG1 and VG2 at time $t_4$. When the switch 43 is turned ON, in one or more embodiments, the output terminal 41 of the DAC $\mathbf{23}_i$ is electrically connected to the input terminal 31 of the source amplifier $\mathbf{24}_i$, and thereby the input terminal 31 of the source amplifier $\mathbf{24}_i$ is pulled down to Vmin.

The output terminal 41 of the DA converter $\mathbf{23}_i$ may be directly connected to the input terminal 31 of the source amplifier $\mathbf{24}_i$ without providing the buffer $\mathbf{25}_i$, increasing the effective input capacitance of the source amplifier $\mathbf{24}_i$ viewed from the DA converter $\mathbf{23}_i$, which may significantly delay changes in the input voltage $V_{IN1}$ supplied to the input terminal 31 of the source amplifier $\mathbf{24}_i$ from changes in the image data $D_i$. In FIG. 5, the broken lines indicate example waveforms of the input voltage $V_{IN1}$ and the input current $I_{IN1}$ for the case when the output terminal 41 of the DAC $\mathbf{23}_i$ is directly connected to the input terminal 31 of the source amplifier $\mathbf{24}_i$.

The circuit configuration illustrated in FIG. 5 effectively reduces the delays in rising and falling of the input voltage $V_{IN1}$ supplied to the input terminal 31 of the source amplifier $\mathbf{24}_i$ through the effect of the buffer $\mathbf{25}_i$. In one or more embodiments, when the buffer $\mathbf{25}_i$ is provided, Miller effect is significantly reduced since the buffer $\mathbf{25}_i$ does not have a voltage amplifying function. In one embodiment, when the buffer $\mathbf{25}_i$ is provided, no Miller effect occurs since the buffer $\mathbf{25}_i$ does not have a voltage amplifying function. This reduces the effective input capacitance of the buffer $\mathbf{25}_i$ viewed from the DAC $\mathbf{23}_i$, and therefore the gate voltage of the NMOS transistor MN1 of the buffer $\mathbf{25}_i$ is rapidly driven to the grayscale voltage $PV_{IN1}$ as desired. Although the NMOS transistor MN1 and the PMOS transistor MP1 do not drive the input terminal 31 of the source amplifier $\mathbf{24}_i$ to the grayscale voltage $PV_{IN1}$, the input terminal 31 of the source amplifier $\mathbf{24}_i$ can be driven to the grayscale voltage $PV_{IN1}$ by turning on the switch 43. In one or more embodiments, the timing at which the switch 43 is turned ON is appropriately adjusted to drive the input voltage $V_{IN1}$ supplied to the input terminal 31 of the source amplifier $\mathbf{24}_i$ to the grayscale voltage $PV_{IN1}$.

Similarly, the buffer $\mathbf{26}_i$, which is configured similarly to the buffer $\mathbf{25}_i$, reduces delays in rising and falling of the input voltage $V_{IN2}$ supplied to the input terminal 32 of the source amplifier $\mathbf{24}_i$.

Figure 6:
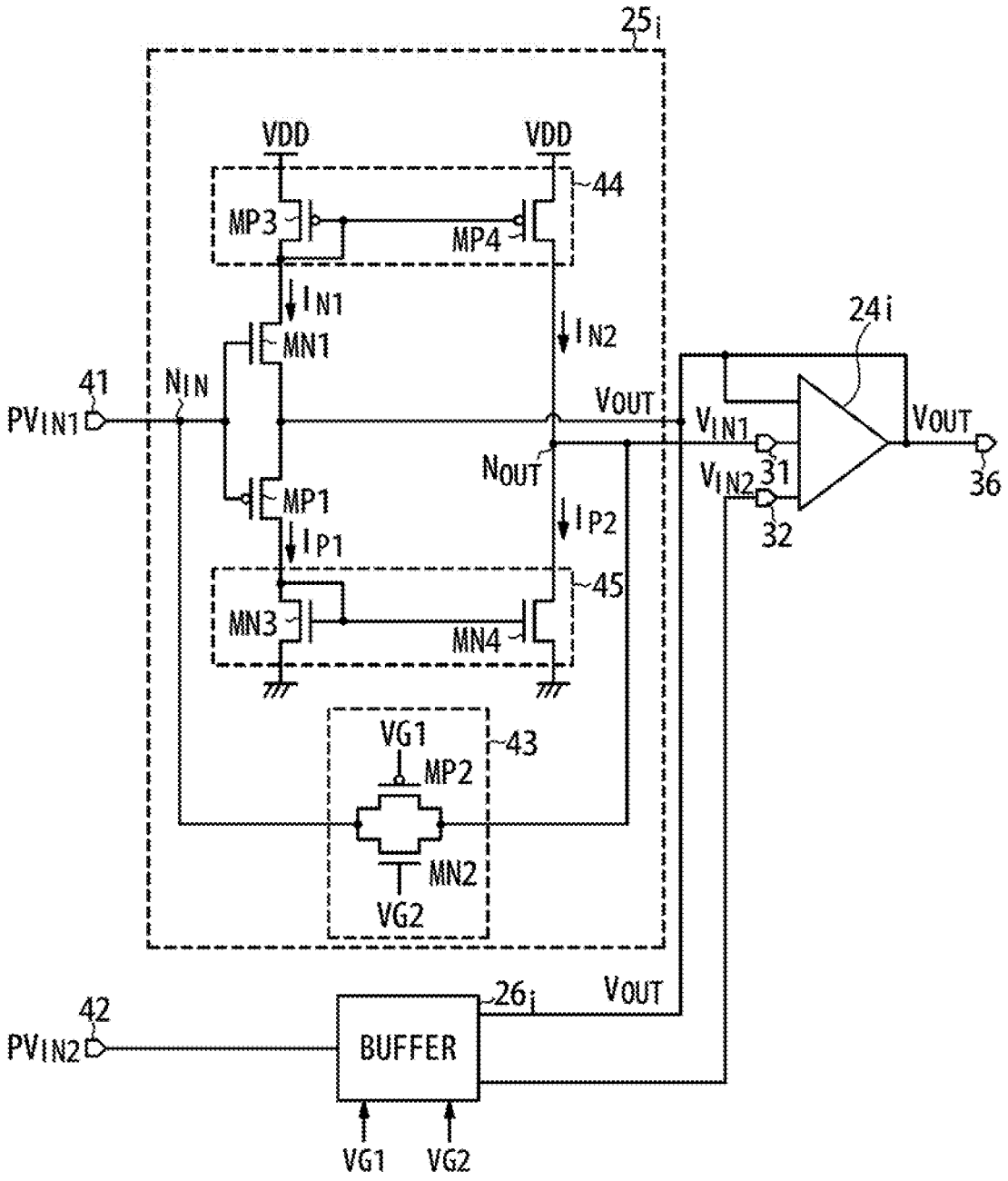
FIG. 6 is a circuit diagram illustrating an example configuration of a buffer, according to alternative embodiments.

In one or more embodiments, as illustrated in FIG. 6, the buffer $\mathbf{25}_i$ comprises current mirrors 44 and 45 in addition to the NMOS transistor MN1, the PMOS transistor MP1, and the switch 43. In one or more embodiments, the source of the NMOS transistor MN1 and the drain of the PMOS transistor MP1 are commonly connected to the output terminal 36 of the source amplifier $\mathbf{24}_i$.

In one or more embodiments, the current mirror 44 comprises PMOS transistors MP3 and MP4. In one or more embodiments, sources of the PMOS transistors MP3 and MP4 are commonly connected to the power supply and gates of the same are commonly connected to a drain of the PMOS transistor MP3. In one or more embodiments, the PMOS transistor MP3 has a drain connected to the drain of the NMOS transistor MN1 and the PMOS transistor MP4 has a drain connected to the output node $N_{OUT}$ In one or more embodiments, the current mirror 44 is configured to supply to the input terminal 31 of the source amplifier $\mathbf{24}_i$ a current $I_{N2}$ that depends on the current $I_{N1}$ that flows through the NMOS transistor MN1. In one or more embodiments, the current $I_{N2}$ is proportional to the current $I_{N1}$.

In one or more embodiments, the current mirror 45 comprises NMOS transistors MN3 and MN4. In one or more embodiments, sources of the NMOS transistors MN3 and MN4 are commonly connected to the circuit ground and gates of the same are commonly connected to a drain of the NMOS transistor MN3. In one or more embodiments, the NMOS transistor MN3 has a drain connected to the drain of the PMOS transistor MP1, and the NMOS transistor MN4 has a drain connected to the output node $N_{OUT}$. In one or more embodiments, the current mirror 45 is configured to draw from the input terminal 31 of the source amplifier $\mathbf{24}_i$ a current $I_{P2}$ that depends on the current $I_{P1}$ that flows through the PMOS transistor MP1. In one or more embodiments, the current $I_{P2}$ is proportional to the current $I_{P1}$.

In one or more embodiments, the buffer $\mathbf{26}_i$ is configured similarly to the buffer $\mathbf{25}_i$.

In one or more embodiments, the buffer $\mathbf{25}_i$ illustrated in FIG. 6 operates similarly to the buffer $\mathbf{25}_i$ illustrated in FIG. 4.

In one or more embodiments, the buffer $\mathbf{25}_i$ illustrated in FIG. 6 pulls up the input terminal 31 of the source amplifier $\mathbf{24}_i$ to a voltage level higher than $PV_{IN1}-V_{TH_N}$, where $PV_{IN1}$ is the grayscale voltage supplied from the DAC $\mathbf{23}_i$ and $V_{TH_N}$ is the threshold voltage of the NMOS transistor MN1. Due to a delay in the source amplifier $\mathbf{24}_i$, the output voltage $V_{OUT}$ of the source amplifier $\mathbf{24}_i$ remains unchanged for a while after a change in the image data $D_i$ supplied to the DAC $\mathbf{23}_i$. Accordingly, the gate-source voltage of the NMOS transistor MN1 is sufficiently large for a while after the change in the image data $D_i$, and the NMOS transistor MN1 is kept at the ON state. In one or more embodiments, the current mirror 44 continues to supply the current $I_{N2}$ to the input terminal 31 of the source amplifier $\mathbf{24}_i$, while the NMOS transistor MN1 is kept at the ON state, and this allows pulling up the voltage level on the input terminal 31 of the source amplifier $\mathbf{24}_i$ to a voltage level higher than $PV_{IN1}-V_{TH_N}$.

Through a similar process, the buffer $\mathbf{25}_i$ illustrated in FIG. 6 pulls down the input terminal 31 of the source amplifier $\mathbf{24}_i$ to a voltage level lower than $PV_{IN1}+V_{TH_P}$ in one or more embodiments, where $V_{TH_P}$ is the absolute value of the threshold voltage of the PMOS transistor MP1. As described above, the output voltage $V_{OUT}$ of the source amplifier $\mathbf{24}_i$ remains unchanged for a while after a change in the image data $D_i$ supplied to the DAC $\mathbf{23}_i$. Accordingly, the gate-source voltage of the PMOS transistor MP1 is sufficiently large for a while after the change in the image data $D_i$, and the PMOS transistor MP1 is kept at the ON state. In one or more embodiments, the current mirror 45 continues to draw the current $I_{P2}$ from the input terminal 31 of the source amplifier $\mathbf{24}_i$, while the PMOS transistor MP1 is kept at the ON state, and this allows pulling down the voltage level on the input terminal 31 of the source amplifier $\mathbf{24}_i$ to a voltage level lower than $PV_{IN1}+V_{TH_P}$.

Figure 7:
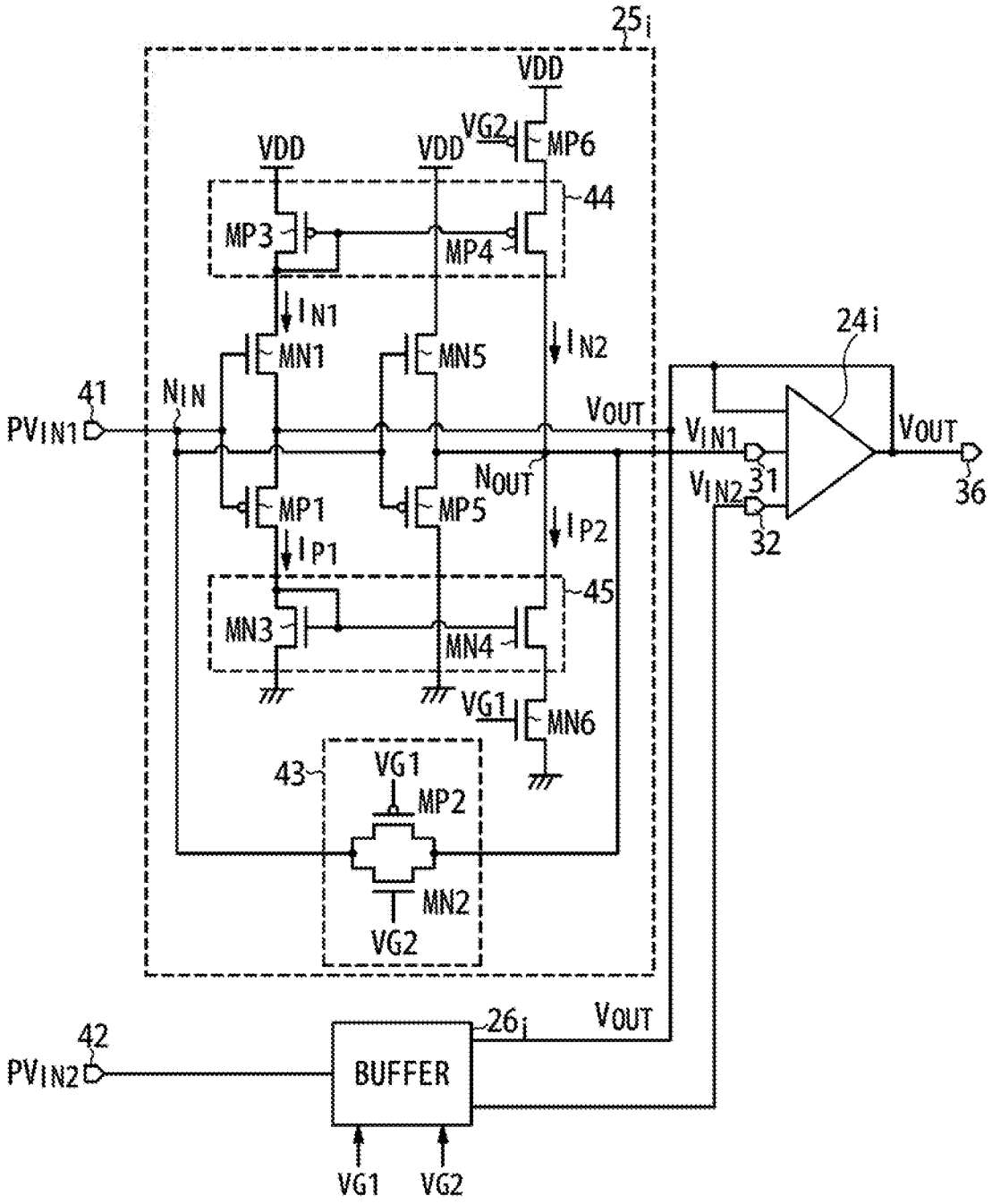
FIG. 7 is a circuit diagram illustrating an example configuration of a buffer, according to alternative embodiments.

In one or more embodiments, as illustrated in FIG. 7, the buffer $\mathbf{25}_i$ is configured similarly to the configuration illustrated in FIG. 6, and further comprises NMOS transistors MN5, MN6 and PMOS transistors MP5 and MP6. In one or more embodiments, the buffer $\mathbf{26}_i$ is configured similarly to the buffer $\mathbf{25}_i$.

In one or more embodiments, gates of the NMOS transistors MN5 and the PMOS transistor MP5 are commonly connected to the input node $N_{IN}$ to receive the grayscale voltage $PV_{IN1}$ from the output terminal 41 of the DAC $\mathbf{23}_i$. In one or more embodiments, the NMOS transistor MN5 has a drain connected to the power supply that supplies the power supply voltage VDD and a source connected to the output node $N_{OUT}$. In one or more embodiments, the PMOS transistor MP5 has a drain connected to the circuit ground and a source connected to the output node $N_{OUT}$.

In one or more embodiments, the PMOS transistor MP6 is connected in series to the current mirror 44 between the power supply and the output node $N_{OUT}$ and operates as a switch operating in response to the control signal VG2. In one or more embodiments, the PMOS transistor MP6 has a source connected to the power supply, a drain connected to the source of the PMOS transistor MP4 of the current mirror 44, and a gate supplied with the control signal VG2. Alternatively, the PMOS transistor MP6 may be connected between the current mirror 44 and the output node $N_{OUT}$.

The NMOS transistor MN6 is connected in series to the current mirror 45 between the circuit ground and the output node $N_{OUT}$ and operates as a switch operating in response to the control signal VG1. In one or more embodiments, the NMOS transistor MN6 has a source connected to the circuit ground, a drain connected to the source of the NMOS transistor MN4 of the current mirror 45, and a gate supplied with the control signal VG1. Alternatively, the NMOS transistor MN6 may be connected between the current mirror 45 and the output node $N_{OUT}$.

The buffer $\mathbf{25}_i$ illustrated in FIG. 7, which operates in a similar way as the buffer $\mathbf{25}_i$ illustrated in FIG. 6, effectively suppresses an overshoot of the voltage level on the input terminal 31 of the source amplifier $\mathbf{24}_i$ through the operations of the NMOS transistor MN5 and the PMOS transistor MP5. In the configuration of the buffer $\mathbf{25}_i$ illustrated in FIG. 6, the current $I_{N2}$ is continuously supplied from the current mirror 44 to the input terminal 31 of the source amplifier $\mathbf{24}_i$ during a pull-up of the input terminal 31 until the output terminal 36 of the source amplifier $\mathbf{24}_i$ is pulled up. This may cause an overshoot of the voltage level on the input terminal 31 of the source amplifier $\mathbf{24}_i$. In the configuration of the buffer $\mathbf{25}_i$ illustrated in FIG. 7, the PMOS transistor MP5 is turned ON when the voltage level on the input terminal 31 of the source amplifier $\mathbf{24}_i$ is excessively increased. This effectively suppresses an overshoot of the voltage level on the input terminal 31. Similarly, the NMOS transistor MN5 is turned ON when the voltage level on the input terminal 31 of the source amplifier $\mathbf{24}_i$ is excessively decreased. This effectively suppresses an undershoot of the voltage level on the input terminal 31 of the source amplifier $\mathbf{24}_i$.

Additionally, in the buffer $\mathbf{25}_i$ illustrated in FIG. 7, the PMOS transistor MP6 and the NMOS transistor MN6 are turned OFF to stop the operations of the current mirrors 44 and 45, when the switch 43 is turned ON in one or more embodiments. This operation effectively shortens the time during which a current flows from the power supply to the circuit ground through the current mirrors 44 and 45, effectively reducing the power consumption.

Figure 8:
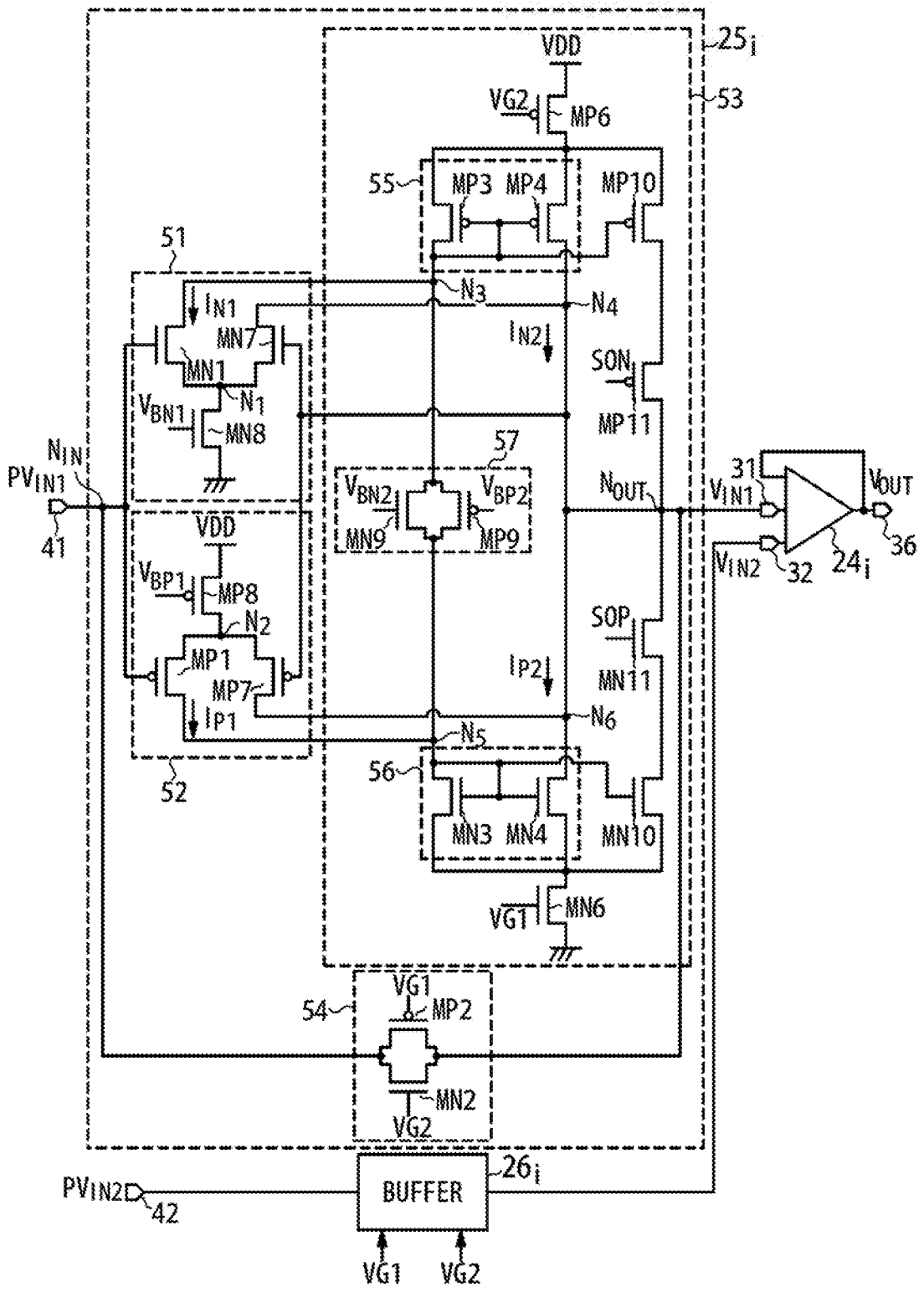
FIG. 8 is a circuit diagram illustrating an example configuration of a buffer, according to alternative embodiments.

In one or more embodiments, as illustrated in FIG. 8, the buffer $\mathbf{25}_i$ is adapted to an "overdriving" operation. In one or more embodiments, the "overdriving" operation involves rapidly pulling up or down the output terminal 36 of the source amplifier $\mathbf{24}_i$, when the output voltage $V_{OUT}$ of the source amplifier $\mathbf{24}_i$ is to be largely changed.

In one or more embodiments, the buffer $\mathbf{25}_i$ is responsive to overdriving control signals SON and SOP for performing the overdriving operation. In one or more embodiments, the overdriving control signal SON is a low active signal and the overdriving control signal SOP is a high active signal. In one or more embodiments, the buffer $\mathbf{25}_i$ is configured to pull up the input terminal 31 of the source amplifier $\mathbf{24}_i$ to the power supply voltage VDD or a voltage close to the power supply voltage VDD, when the overdriving control signal SON is activated. This achieves rapidly pulling up the output terminal 36 of the source amplifier $\mathbf{24}_i$. In one or more embodiments, the buffer $\mathbf{25}_i$ is configured to pull down the input terminal 31 of the source amplifier $\mathbf{24}_i$ to the circuit ground level or a voltage close to the circuit ground level, when the overdriving control signal SOP is activated. This achieves rapidly pulling down the output terminal 36 of the source amplifier $\mathbf{24}_i$.

In one or more embodiments, the buffer $\mathbf{25}_i$ comprises an NMOS differential input stage 51, a PMOS differential input stage 52, active load circuitry 53, and a switch 54.

In one or more embodiments, the NMOS differential input stage 51 comprises NMOS transistors MN1, MN7, and MN8. In one or more embodiments, sources of the NMOS transistors MN1 and MN7 are commonly connected to a node $N_1$. In one or more embodiments, the NMOS transistor MN1 has a drain connected to a node $N_3$ of the active load circuitry 53, and the NMOS transistor MN7 has a drain connected to a node $N_4$ of the active load circuitry 53. In one or more embodiments, the NMOS transistor MN1 has a gate connected to the input node $N_{IN}$ and the NMOS transistor MN7 has a gate connected to the output node $N_{OUT}$, which is connected to the input terminal 31 of the source amplifier $\mathbf{24}_i$. In one or more embodiments, the NMOS transistor MN8 operates as a constant current source configured to draw a constant current from the node $N_1$. In one or more embodiments, the NMOS transistor MN8 has a drain connected to the node $N_1$, a source connected to the circuit ground, and a gate supplied with a bias voltage $V_{BN1}$.

The PMOS differential input stage 52 comprises PMOS transistors MP1, MP7, and MP8. In one or more embodiments, sources of the PMOS transistors MP1 and MP7 are commonly connected to a node $N_2$. In one or more embodiments, the PMOS transistor MP1 has a drain connected to a node $N_5$ of the active load circuitry 53, and the drain of the PMOS transistor MP7 has a drain connected to a node $N_6$ of the active load circuitry 53. In one or more embodiments, the PMOS transistor MP1 has a gate connected to the input node $N_{IN}$ and the PMOS transistor MP7 has a gate connected to the output node $N_{OUT}$. In one or more embodiments, the PMOS transistor MP8 operates as a constant current source configured to supply a constant current to the node $N_2$. In one or more embodiments, the PMOS transistor MP8 has a drain connected to the node $N_2$, a source connected to the power supply, and a gate supplied with a bias voltage $V_{BP1}$.

In one or more embodiments, the active load circuitry 53 is connected to the drains of the NMOS transistor MN1 and the NMOS transistor MN7 and the drains of the PMOS transistor MP1 and the PMOS transistor MP7. In one or more embodiments, the active load circuitry 53 comprises current mirrors 55, 56, a floating constant current source 57, PMOS transistors MP6, MP10, MP11, and NMOS transistors MN6, MN10 and MN11.

In one or more embodiments, the PMOS transistor MP6 and the NMOS transistor MN6 are configured to enable the current mirrors 55 and 56 in response to the control signals VG1 and VG2, which are also used to control the switch 54. In one or more embodiments, the PMOS transistor MP6 has a source connected to the power supply and a drain connected to the current mirror 55. The PMOS transistor MP6 has a gate supplied with the control signal VG2. The NMOS transistor MN6 has a source connected to the circuit ground, a drain connected to the current mirror 56, and a gate supplied with the control signal VG1.

In one or more embodiments, the current mirror 55 is connected between the drain of the PMOS transistor MP6 and the nodes $N_3$ and $N_4$. In one or more embodiments, the current mirror 55 comprises PMOS transistors MP3 and MP4. In one or more embodiments, sources of the PMOS transistors MP3 and MP4 are commonly connected to the drain of the PMOS transistor MP6, and gates of the PMOS transistors MP3 and MP4 are commonly connected to a drain of the PMOS transistor MP3. In one or more embodiments, the drains of the PMOS transistors MP3 and MP4 are connected to the nodes $N_3$ and $N_4$, respectively.

In one or more embodiments, the current mirror 56 is connected between the drain of the NMOS transistor MN6 and the nodes $N_5$ and $N_6$. In one or more embodiments, the current mirror 56 comprises NMOS transistors MN3 and MN4. In one or more embodiments, sources of the NMOS transistors MN3 and MN4 are commonly connected to the drain of the NMOS transistor MN6, and gates of the NMOS transistors MN3 and MN4 are commonly connected to a drain of the NMOS transistor MN3. In one or more embodiments, the drains of the NMOS transistors MN3 and MN4 are connected to the nodes $N_5$ and $N_6$, respectively.

In one or more embodiments, the floating constant current source 57 is configured to draw a constant current from the node $N_3$, and supply the constant current to the node $N_5$. In one or more embodiments, the floating constant current source 57 comprises an NMOS transistor MN9 and a PMOS transistor MP9. In one or more embodiments, a drain of the NMOS transistor MN9 and a source of the PMOS transistor MP9 are commonly connected to the node $N_3$, and a source of the NMOS transistor MN9 and a drain of the PMOS transistor MP9 are commonly connected to the node $N_5$. A bias voltage $V_{BN2}$ is supplied to a gate of the NMOS transistor MN9, and a bias voltage $V_{BP2}$ is supplied to a gate of the PMOS transistor MP9.

In one or more embodiments, the switch 54 is connected between the input node $N_{IN}$ and the output node $N_{OUT}$. In one or more embodiments, the switch 54 is configured to electrically connect and disconnect the input node $N_{IN}$ and the output node $N_{OUT}$ in response to the control signals VG1 and VG2. In one or more embodiments, the switch 54 comprises an NMOS transistor MN2 and a PMOS transistor MP2, which form a transmission gate. In one or more embodiments, the NMOS transistor MN2 has a drain connected to the input node $N_{IN}$ and a source connected to the output node $N_{OUT}$. In one or more embodiments, the PMOS transistor MP2 has a source connected to the input node $N_{IN}$ and a drain connected to the output node $N_{OUT}$. In one or more embodiments, the gate of the PMOS transistor MP2 is supplied with the control signal VG1 and the gate of the NMOS transistor MN2 is supplied with a control signal VG2.

In one or more embodiments, the PMOS transistors MP10, MP11 and the NMOS transistors MN10 and MN11 are used to achieve the overdriving operation in response to the overdriving control signals SON and SOP. In one or more embodiments, the PMOS transistors MP10 and MP11 are connected in series between the drain of the PMOS transistor MP6 and the output node $N_{OUT}$. In one or more embodiments, the PMOS transistor MP10 has a source connected to the drain of the PMOS transistor MP6 and a gate connected to the commonly connected gates of the PMOS transistors MP3 and MP4. In one or more embodiments, the PMOS transistor MP11 has a source connected to a drain of the PMOS transistor MP10 and a drain connected to the output node $N_{OUT}$. In one or more embodiments, the PMOS transistor MP11 has a gate supplied with the overdriving control signal SON. In one or more embodiments, the NMOS transistors MN10 and MN11 are connected in series between the drain of the NMOS transistor MN6 and the output node $N_{OUT}$. In one or more embodiments, the NMOS transistor MN10 has a source connected to the drain of the NMOS transistor MN6 and a gate connected to the commonly connected gates of the NMOS transistors MN3 and MN4. In one or more embodiments, the NMOS transistor MN11 has a source connected to a drain of the NMOS transistor MN10, a drain connected to the output node $N_{OUT}$, and a gate supplied with the overdriving control signal SOP.

In one or more embodiments, the buffer $25_i$ illustrated in FIG. 8 is configured to drive the input terminal 31 of the source amplifier $24_i$ through a source follower operation, when both of the overdriving control signals SON and SOP are deactivated.

In one or more embodiments, when the grayscale voltage $PV_{IN1}$ is pulled up, a current $I_{N1}$ is generated through the NMOS transistor MN1, depending on the grayscale voltage $PV_{IN1}$ supplied to the gate of the NMOS transistor MN1, and the current mirror 55 supplies the current $I_{N2}$ depending on the current $I_{N1}$ to the input terminal 31 of the source amplifier $24_i$ to increase the input voltage $V_{IN1}$. In one or more embodiments, this is followed by setting the switch 54 to the ON state by the control signals VG1 and VG2. When the switch 54 is turned ON, in one or more embodiments, the output terminal 41 of the DAC $23_i$ is electrically connected to the input terminal 31 of the source amplifier $24_i$, and thereby the input terminal 31 of the source amplifier $24_i$ is pulled up to the grayscale voltage $PV_{IN1}$.

In one or more embodiments, when the grayscale voltage $PV_{IN1}$ is pulled down, a current $I_{P1}$ is generated through the PMOS transistor MP1, depending on the grayscale voltage $PV_{IN1}$ supplied to the gate of the PMOS transistor MP1, and the current mirror 56 draws a current $I_{P2}$ that depends on the current $I_{P1}$ from the input terminal 31 of the source amplifier $24_i$ to decrease the input voltage $V_{IN1}$. In one or more embodiments, this is followed by setting the switch 54 to the ON state by the control signals VG1 and VG2. When the switch 54 is turned ON, in one or more embodiments, the output terminal 41 of the DAC $23_i$ is electrically connected to the input terminal 31 of the source amplifier $24_i$, and thereby the input terminal 31 of the source amplifier $24_i$ is pulled down to the grayscale voltage $PV_{IN1}$.

Use of the NMOS and PMOS differential input stages 51 and 52 as illustrated in FIG. 8 effectively reduces or eliminates the dead band in which none of the NMOS transistor MN1 and the PMOS transistor MP1 operates as a source follower. In one or more embodiments, at least one of the NMOS transistor MN1 and the PMOS transistor MP1 operates as a source follower to control the current $I_{N2}$ and/or the current $I_{P2}$ for the full allowed range of the grayscale voltage $PV_{IN1}$.

In one or more embodiments, when one of the overdriving control signals SON and SOP is activated, the buffer $25_i$ operates to achieve the overdriving operation. In one or more embodiments, when the overdriving control signal SON is activated, the PMOS transistor MP11 is turned ON. In one or more embodiments, this achieves driving the input terminal 31 of the source amplifier $24_i$ to the power supply voltage VDD or a voltage close to the power supply voltage VDD, independently of the grayscale voltage $PV_{IN1}$. In one or more embodiments, when the overdriving control signal SOP is activated, the NMOS transistor MN11 is turned ON. In one or more embodiments, this achieves driving the input terminal 31 of the source amplifier $24_i$ to the circuit ground level or a voltage close to the circuit ground level, independently of the grayscale voltage $PV_{IN1}$.

Although various embodiments of this disclosure have been specifically described in the above, a person skilled in the art would appreciate that the technologies disclosed in this disclosure may be implemented with various modifications. For example, although the above-described embodiments recite the configuration in which each source amplifier $24_i$ comprises two input terminals 31 and 32, the number of the input terminals of each source amplifier 24*i* is not limited to two. Each source amplifier $24_i$ may comprise a single input terminal, or three or more input terminals. In this case, a buffer configured in the same configuration as the above-described buffer $25_i$ is connect to each input terminal of the source amplifier $24_i$.

What is claimed is:

1. A display driver, comprising:

a digital-to-analog converter (DAC) configured to output a grayscale voltage corresponding to image data;

a source amplifier configured to drive a source line of a display panel; and a buffer connected between the DAC and the source amplifier, wherein the buffer comprises:

a first NMOS transistor having a gate supplied with the grayscale voltage and a drain connected to a power supply, and a first PMOS transistor having a gate supplied with the grayscale voltage and a drain connected to a circuit ground, and wherein the buffer is configured to:

supply a current corresponding to a first current flowing through the first NMOS transistor to an input terminal of the source amplifier, and draw a current corresponding to a second current flowing through the first PMOS transistor from the input terminal of the source amplifier.

2. The display driver according to claim 1, wherein the buffer further comprises a first switch connected between an output terminal of the DAC and the input terminal of the source amplifier.

3. The display driver according to claim 1, wherein an output terminal of the source amplifier is connected to a source of the first NMOS transistor, and wherein the buffer further comprises a current mirror configured to:

generate a third current corresponding to the first current; and supply the third current to the input terminal of the source amplifier.

4. The display driver according to claim 3, wherein the buffer further comprises a first switch connected between an output terminal of the DAC and the input terminal of the source amplifier.

5. The display driver according to claim 1, wherein a source of the first NMOS transistor and a source of the first PMOS transistor are commonly connected to an output terminal of the source amplifier, and wherein the buffer further comprises:

a first current mirror configured to supply a third current corresponding to the first current to the input terminal of the source amplifier; and a second current mirror configured to draw a fourth current corresponding to the second current from the input terminal of the source amplifier.

6. The display driver according to claim 5, wherein the buffer further comprises:

a second NMOS transistor comprising:

a gate supplied with the grayscale voltage;

a drain connected to the power supply; and a source connected to the input terminal of the source amplifier; and a second PMOS transistor comprising:

a gate supplied with the grayscale voltage;

a drain connected to the circuit ground; and a source connected to the input terminal of the source amplifier.

7. The display driver according to claim 5, wherein the buffer further comprises a second switch connected in series to the first current mirror between the power supply and the input terminal of the source amplifier.

8. The display driver according to claim 5, wherein the buffer further comprises:

a second switch connected in series to the first current mirror between the power supply and the input terminal of the source amplifier; and a third switch connected in series to the second current mirror between the circuit ground and the input terminal of the source amplifier.

9. The display driver according to claim 8, wherein the buffer further comprises a first switch connected between an output terminal of the DAC and the input terminal of the source amplifier, and wherein the second switch and the third switch are turned off when the first switch is turned on.

10. The display driver according to claim 8, wherein the buffer further comprises:

a second NMOS transistor comprising:

a gate supplied with the grayscale voltage;

a drain connected to the power supply; and a source connected to the input terminal of the source amplifier; and a second PMOS transistor comprising:

a gate supplied with the grayscale voltage;

a drain connected to the circuit ground; and a source connected to the input terminal of the source amplifier.

11. The display driver according to claim 1, wherein the buffer further comprises:

a third NMOS transistor comprising:

a source connected to a source of the first NMOS transistor; and a gate connected to the input terminal of the source amplifier; and a third PMOS transistor comprising:

a source connected to a source of the first PMOS transistor; and a gate connected to the input terminal of the source amplifier.

12. The display driver according to claim 11, wherein the buffer further comprises:

a first constant current source configured to draw a first constant current from the sources of the first NMOS transistor and the third NMOS transistor; and a second constant current source configured to supply a second constant current to the sources of the first PMOS transistor and the third PMOS transistor.

13. The display driver according to claim 11, wherein the buffer further comprises active load circuitry connected to drains of the first NMOS transistor and the third NMOS transistor and drains of the first PMOS transistor and the third PMOS transistor, and wherein the active load circuitry is configured to:

supply a third current corresponding to the first current to the input terminal of the source amplifier; and draw a fourth current corresponding to the second current from the input terminal of the source amplifier.

14. The display driver according to claim 1, wherein the buffer further comprises:

a first switch connected between a power supply and the input terminal of the source amplifier and configured to operate in response to a first overdriving control signal; and a second switch connected between a circuit ground and the input terminal of the source amplifier and configured to operate in response to a second overdriving control signal.

15. The display driver according to claim 1, further comprising:

grayscale voltage generator circuitry configured to generate a plurality of grayscale voltages on a plurality of grayscale voltage lines, respectively, wherein the DAC is further configured to:

select at least one of the plurality of the grayscale voltage lines based on the image data; and connect the at least one of the plurality of the grayscale voltage lines to the buffer.

16. A display device, comprising:

a display panel comprising a source line; and a display driver comprising:

a digital-to-analog converter (DAC) configured to output a grayscale voltage corresponding to an image data;

a source amplifier configured to drive the source line; and a buffer connected between the DAC and the source amplifier, wherein the buffer comprises:

a first NMOS transistor having a gate supplied with the grayscale voltage and a drain connected to a power supply, and a first PMOS transistor having a gate supplied with the grayscale voltage and a drain connected to a circuit ground, and wherein the buffer is configured to:

supply a current corresponding to a first current flowing through the first NMOS transistor to an input terminal of the source amplifier, and draw a current depending on a second current flowing through the first PMOS transistor from the input terminal of the source amplifier.

17. The display device according to claim 16, wherein the buffer further comprises a first switch connected between an output terminal of the DAC and the input terminal of the source amplifier.

18. A method of driving a display panel, comprising:

outputting a grayscale voltage corresponding to an image data;

supplying, to an input terminal of a source amplifier, a current corresponding to a first current flowing through an NMOS transistor which has a gate supplied with the grayscale voltage and a drain connected to a power supply;

drawing from the input terminal of the source amplifier a current corresponding to a second current flowing through a PMOS transistor which has a gate supplied with the grayscale voltage and a drain connected to a circuit ground; and driving a source line of the display panel with the source amplifier, wherein the source of the NMOS transistor is connected to the source of the PMOS transistor.

19. The method according to claim 18, further comprising:

electrically connecting an output terminal of a digital-to-analog converter (DAC) configured to output the grayscale voltage and an input terminal of the source amplifier.

* * * * *